US005394684A

United States Patent [19]

Pohn et al.

[11] Patent Number: 5,394,684

[45] Date of Patent: Mar. 7, 1995

[54] YARN STORAGE MECHANISM

[75] Inventors: Romeo Pohn, Ingolstadt; Jurgen Eckart, Kipfenberg; Edmund Schuller, Ingolstadt; Thomas Meier, Wettstetten, all of Germany

[73] Assignee: Rieter Ingolstadt Spinnereimaschinenbau AG, Germany

[21] Appl. No.: 138,180

[22] Filed: Oct. 15, 1993

[30] Foreign Application Priority Data

Oct. 19, 1992 [DE] Germany ..... 42 35 203.7

[51] Int. Cl.[6] ..... D01H 9/14; D01H 13/04

[52] U.S. Cl. ..... 57/264; 57/352; 226/195; 242/147 R

[58] Field of Search ..... 242/147 R, 131, 131.1; 226/195; 57/264, 58.86, 352, 356

[56] References Cited

U.S. PATENT DOCUMENTS

| | | | |
|---|---|---|---|
| 2,667,773 | 2/1954 | Hepp | 242/147 R |
| 3,877,627 | 4/1975 | Boase et al. | 226/195 X |
| 4,186,896 | 2/1980 | Brandenberger et al. | 57/356 X |
| 4,332,339 | 6/1982 | Luedemann et al. | 226/195 |
| 4,570,874 | 2/1986 | Takeda | 242/147 R |
| 5,239,814 | 8/1993 | Yamada et al. | 242/131 X |

FOREIGN PATENT DOCUMENTS

| | | |
|---|---|---|
| 32480 | 11/1907 | Austria . |
| 664950 | 4/1988 | Czechoslovakia . |
| 0284148 | 9/1988 | European Pat. Off. . |
| 2454916 | 5/1976 | Germany . |
| 3806139A1 | 9/1989 | Germany . |
| 4019108A1 | 12/1991 | Germany . |
| 33866 | 1/1991 | Japan . |
| 1526446 | 9/1978 | United Kingdom . |
| 385875 | 6/1973 | U.S.S.R. . |

*Primary Examiner*—Stanley N. Gilreath
*Assistant Examiner*—William Stryjewski
*Attorney, Agent, or Firm*—Dority & Manning

[57] ABSTRACT

A process and apparatus for the control of a yarn storage mechanism on a spinning mill machine is proposed. When yarns are wound up it may occur, e.g. in forming conical bobbins, that more yarn is delivered than is wound up. The yarn which is briefly in excess is here taken up in form of a yarn loop by a compensator arm which intervenes transversely in the course of the yarn and is mounted so as to be capable of swivelling. According to the invention it is proposed that the compensator arm be subjected to the force of a spring which acts upon it increasingly as the yarn loop decreases, and in that the force of an additional elastic element acts upon the compensator arm as further excursion occurs.

9 Claims, 3 Drawing Sheets

YARN STORAGE MECHANISM

BACKGROUND OF THE INVENTION

The instant invention relates to a process for the control of a yarn storage mechanism, as well as to a spinning device incorporating the process. In particular, when conical bobbins are wound, e.g. on open-end rotor spinning machines, the problem exists that the yarn which is delivered at a constant speed cannot be wound up at constant speed by the winding mechanism on a cross-wound bobbin. As is known, the cause for this is that conical bobbins rotate at a constant speed but have different circumferential lengths because of their conicity. To solve this problem, the state of the art has proposed to use yarn storage mechanisms which ensure that yarn which cannot be wound up at the moment is placed in intermediate storage, this yarn storage being filled to a maximum when the yarn guide deposits the yarn in the area of the smaller diameter of the conical bobbin. The yarn storage contains the shortest yarn loop when the yarn guide deposits yarn in the area of the larger diameter of the conical bobbin. DE 38 06 139 A1 proposes for example to make the yarn storage mechanism in the form of a swivelling lever which is positively controlled as a function of the movement of the yarn guide. Similarly, to control jigging of the yarn guides, a jigging rod extending over the spinning machine is provided for this. The yarn is taken from the yarn storage mechanism and is formed into a loop at a right angle to its direction of movement, whereby this loop can be enlarged or reduced as required by the swivelling lever.

DE-A 24 54 916 discloses a winding mechanism for conical cross-wound bobbins whereby a yarn storage mechanism is provided to receive the periodically produced excess yarn, the yarn storage mechanism being made in the form of a spring-loaded compensator arm which deflects the yarn at a right angle to the direction of yarn movement and holds it under tension. Under the influence of the spring, the size of the yarn loop increases automatically when more yarn is delivered than is wound up. Inversely, the yarn storage mechanism is able to dispense yarn when needed. The yarn loop is not subjected to positive control.

A similar yarn storage mechanism is known from the rotor spinning machine RU 14 of Schubert & Salzer Maschinenfabrik Aktiengesellschaft in D 8070 Ingolstadt, in which the compensator arm deflects the yarn at a right angle to the bobbin axis in direction of the interior of the machine. The force acting upon the compensator arm can be adjusted by means of an adjusting mechanism so that bobbins with different yarn tensions can be produced at the winding station. Such yarn storage mechanisms are not only used for the winding of conical bobbins, but also if the yarn is paraffined at the same time, for example, as it is wound up. The irregularities which then occur in the yarn tension are compensated for by the yarn storage mechanism.

The known yarn storage mechanisms have the disadvantage that contact between compensator arm and yarn is not always ensured beyond the operating range of the compensator arm when yarn tension changes or when the yarn loop becomes smaller. When the compensator arm is moved rapidly in direction of its end position within its operating range as the yarn tension increases, it may occur that the compensator arm detaches itself from the yarn and is then brought back suddenly towards it under the force of the spring. This may cause yarn breakage.

OBJECTS AND SUMMARY OF THE INVENTION

It is therefore a principal object of the instant application to avoid the disadvantages of the state of the art and to propose a yarn storage mechanism for a spinning mill machine which guides the yarn securely and avoids tension peaks, even if the compensator arm is deflected beyond its normal operating range. Additional objects and advantages of the invention will be set forth in part in the following description, or may be obvious from the description, or may be learned by practice of the invention.

The design according to the invention of the spinning device, i.e. of its yarn storage mechanism , ensures that when tension peaks occur in the yarn when the yarn storage mechanism is at its maximum, this will not cause yarn breakage. The compensator arm is not lifted off the yarn by the stretching yarn but remains constantly in contact with it. Additional stress of the yarn by a sudden return of the compensator arm towards the yarn can be avoided thereby. It is especially advantageous to provide a stop with which the compensator arm comes into contact before it leaves its normal operating range. It is especially easy to install an additional elastic element on this stop, since its force is then transferred to the compensator arm. It is especially advantageous if the force of the additional elastic element is considerably greater than that of the first elastic element. This safely ensures that the tension peaks in the yarn can be absorbed.

In an especially advantageous embodiment of the yarn storage mechanism, the compensator arm has an extension which extends beyond its pivoting point and by means of which it interacts with the stop and the additional elastic element. It is a further advantage that an automatic servicing device, of a spinning mill machine for example, is able to move the compensator arm by this extension. This is required for piecing on an open-end spinning machine, for instance. Furthermore it makes it possible to control the laying of the compensator arm on the yarn with utmost precision.

In another advantageous embodiment of the invention the first elastic element is attached via a swivelling arm. By swivelling the swivelling arm, the pre-stress of the first elastic element is changed. This makes it possible to set the tension of the yarn With which it is to be wound up on the bobbin. An embodiment of the invention is especially advantageous if the swivelling arms of one machine side, for example, or several winding stations on the spinning mill machine are interconnected via a control rod. This makes it possible to set the yarn tension simultaneously on all or several winding stations. All that is required to achieve this is to adjust the control rod, e.g. at the end stock of the machine. It is especially advantageous if the yarn storage mechanism is designed so that the compensator arm executes its movement in a horizontal plane. This makes it possible to avoid influences of gravity upon the compensator arm, so that the yarn to be wound up can better be maintained at a constant tension. Thanks to this arrangement of the compensator arm it has to be moved only against its mass inertia. A movement against gravity, e.g. by lifting the center of gravity where the compensator arm moves in a vertical plane, is no longer necessary.

The invention is described below through drawings which illustrate embodiments of the invention.

DETAILED DESCRIPTION OF THE PREFERRED EMBODIMENTS

Figure 1:
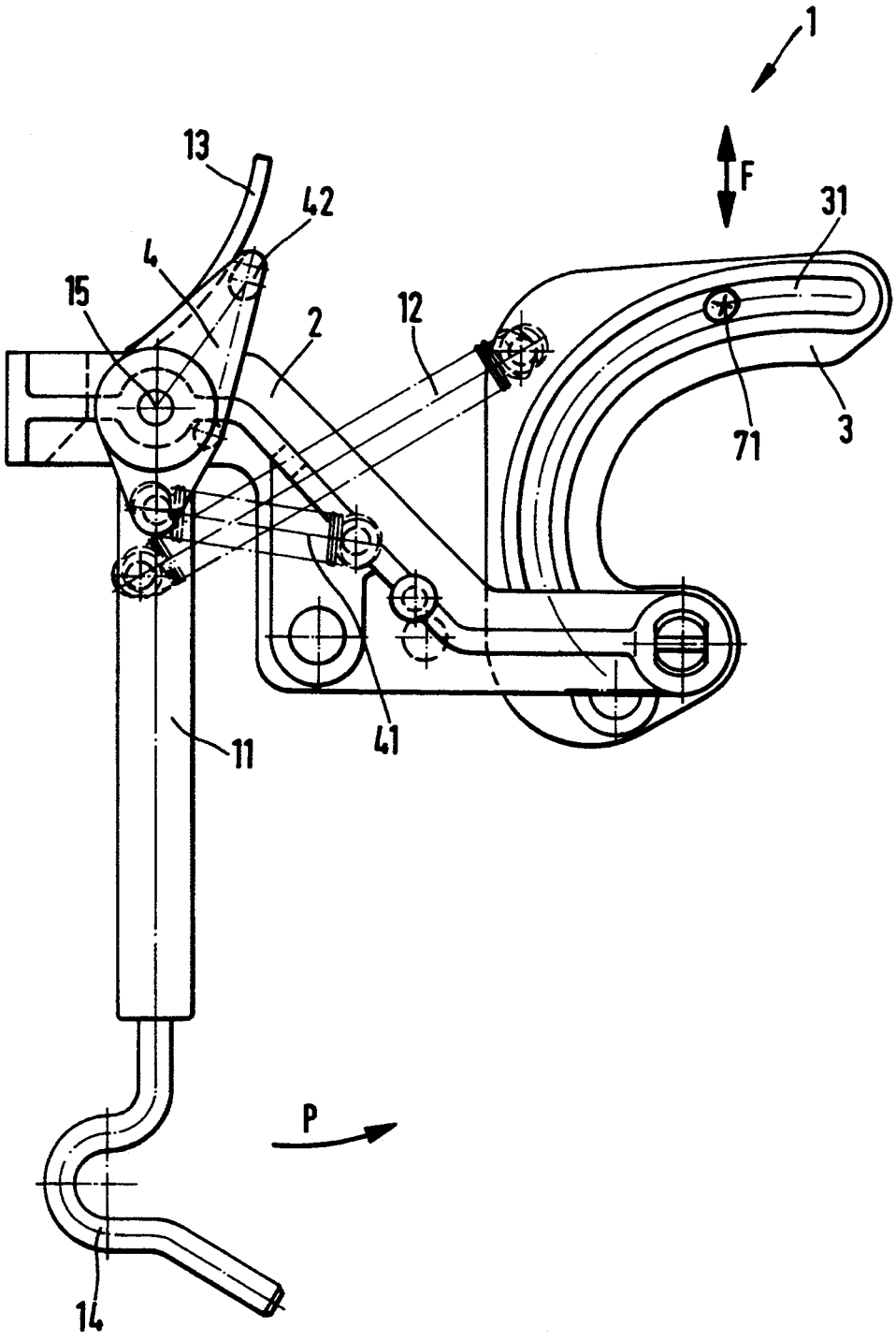
FIG. 1 shows a yarn storage mechanism of a spinning mill machine according to the invention.

Reference will now be made in detail to the presently preferred embodiments of the invention, one or more examples of which are illustrated in the drawings. Each example is provided by way of explanation of the invention, and not limitation of the invention. The numbering of components is consistent throughout the application, with the same components having the same number in each of the drawings.

Figure 3:
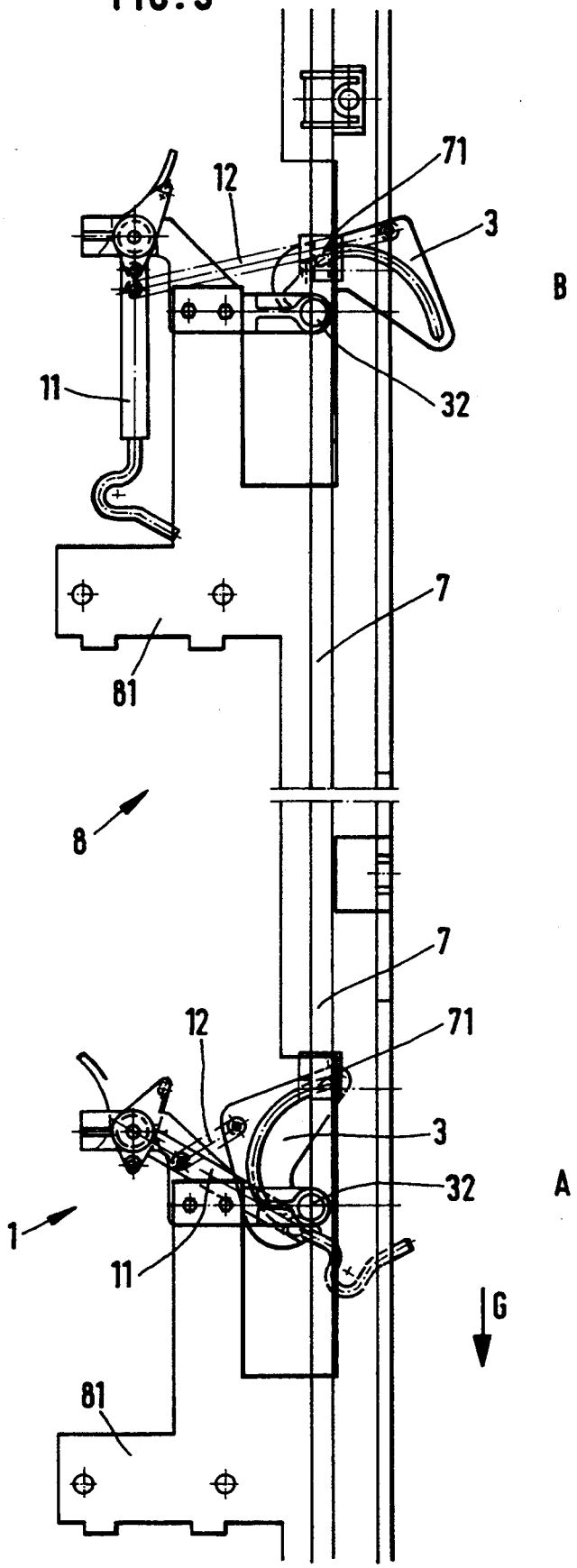
FIG. 3 is a top view of two yarn storage mechanisms according to the invention, both connected by means of a control rod which connects several yarn storage mechanisms with each other.

The yarn storage mechanism 1 according to the invention is provided with a compensator arm 11 mounted rotatably on a base body 2. A swivelling arm 3 is rotatably attached to the base body 2. An elastic element 12 is stretched from the swivelling arm 3 to the compensator arm 11 and subjects the compensator arm 11 to a force enabling it to form a yarn loop in opposition to the tension of the yarn. The swivelling arm 3 is provided with a groove 31 into which a control pin 71 of a control rod 7 enters (see FIG. 3). The stop 4, which is held by means of an additional elastic element 41 in its base position as shown in FIG. 1, is rotatably mounted on the base body 2. The compensator arm 11 has an extension 13 by which it is in contact with a pin 42 of stop 4 as shown in FIG. 1. The course of the yarn extends at a right angle, perpendicular to the plane of the drawing of FIG. 4. The plane of the yarn storage mechanism 1 which it occupies in FIG. 1 is placed so as to be parallel with the friction roller by means of which the conical bobbin is driven. FIG. 3 shows the arrangement of the yarn storage mechanisms 1 next to each other in the spinning mill machine, whereby the machine extends in depth from the control rod 7 to the right. By contrast to the compensator arm in the figure of DE-OS 24 54 916, where the compensator arm forms the yarn loop parallel to the bobbin, it is formed at a perpendicular to the axis of the bobbin by yarn storage mechanism 1 of FIG. 1.

The compensator arm 11 of FIG. 1 is shown in one end position within its operating range. This is the position in which it is deflected most frequently, without yet being subjected to the force of the additional elastic element 41. The yarn loop is formed or enlarged by the compensator arm 11 in that it swivels to the right, in the direction of arrow P, when viewing FIG. 1. The force which the first elastic element 12 exerts upon it becomes weaker thereby, since it is a spring with an elastic constant. The course of the yarn is different than with the compensator arm of DE-OS 24 54 916, going not over rollers, but being guided through the hooks 14 of the compensator arm 11. In case the tension of the yarn increases, even though the compensator arm 11 is already positioned at its end position as shown in FIG. 1, additional force, in opposition to the arrow direction P, is applied by the yarn upon the compensator arm 11. As a result, it touches with its extension 13 against pin 42 of stop 4 so that the latter is rotated clockwise. This rotation takes place in opposition to the resistance of the additional elastic element 41 which is in the form of a spring. All this has as a consequence that the compensator arm 11 is subjected to additional force which acts upon it in the arrow direction P. The effect of this additional force is that the compensator arm 11 can be moved only very little beyond its operating range. This prevents the yarn from remaining in the yarn loop without being acted upon by the compensator arm 11. This is important because it prevents the occurrence of yarn breakage.

Thanks to the extension 13, it is easy for an automatic servicing device to swivel the compensator arm 11 into a desired position. Thus for example, it is necessary in open-end devices for the compensator arm 11 to continue being swivelled against the arrow direction P during the piecing process. This is necessary so that the yarn may be fed back for piecing. The extension 13 makes it possible to easily control the compensator arm by means of a servicing device, because the extension 13 can be pushed easily in the direction of the swivelling arm 3, e.g. by a rod.

In order to adjust the elastic force of spring 12 of the first elastic element, a control pin 71 (see also FIG. 3) is moved in the direction of arrow F. This causes the swivelling arm 3 to turn to the right or to the left, causing the spring 12 to be turned accordingly. The swivelling arm 3 is mounted rotatably around attachment 32. The yarn tension of the wound-up yarn can easily be adjusted thereby.

Figure 2:
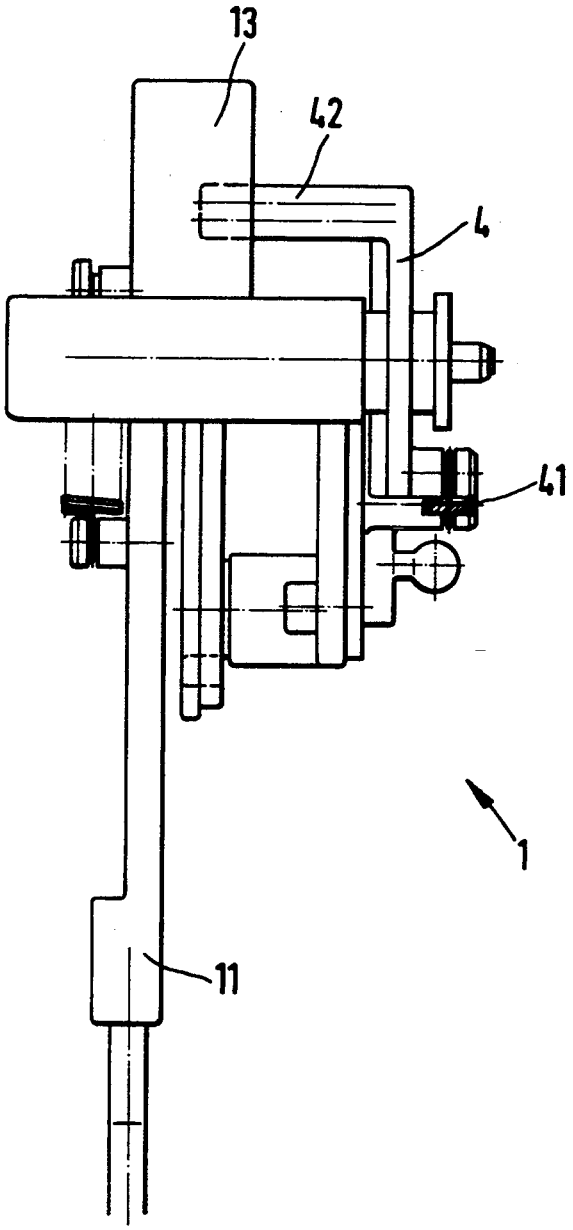
FIG. 2 shows the yarn storage mechanism of FIG. 1 in a side view.

FIG. 2 shows a side view of the yarn storage mechanism 1 of FIG. 1. As the compensator arm 11 is swivelled against the arrow direction P of FIG. 1, the extension 13 comes into contact with pin 42 of stop 4, causing it to be rotated, bringing at the same time the force of the additional elastic element 41 to bear upon the compensator arm 11. Especially good control of the compensator arm 11 by a servicing device is made possible by a design lending a large surface to the extension 13.

FIG. 3 shows two yarn storage mechanisms 1 mounted in the spinning mill machine 8, with parts of the machine frame 81 being visible. The control rod 7 serving to adjust the pre-stress of the spring 12 is also mounted on the machine frame 81. The yarn storage mechanism A, at the bottom of the drawing of FIG. 3, is a yarn storage mechanism whose swivelling arm 3 is in a position similar to that of FIG. 1. The spring 12 is subjected to only little tension. By shifting the control rod 7 in FIG. 3 A in the direction of arrow G, the swivelling arm 3 is placed in the position shown in FIG. 3 B. The spring 12 is prestressed to a maximum in this position. The swivelling arm 3 is swivelled in that the control pin in groove 31 of swivelling arm 3 is shifted, whereby the control pin 71 can only be moved in the arrow direction G and against it. Due to the fact that it is unable to move transversely, swivelling arm 3 is forced to swivel around its attachment 3, so that greater or lower tension in spring 12 is produced. The control rod 7 may be designed so that it is guided alongside an entire machine side, and so that all yarn storage mechanisms connected thereto can be adjusted simultaneously with respect to the pre-stress of their spring 12.

The yarn storage mechanisms are positioned in the spinning mill machine 8 so that their compensator arms 11 execute their movement in a horizontal plane. Thanks to this arrangement, no influences of gravity are transferred upon the yarn guided by the compensator arm. Thanks to the light construction of the compensator arm 11, the influences produced by the inertia of the compensator arm upon the yarn are also minimal.

It will be apparent to those skilled in the art that various modifications and variations can be made in the present invention without departing from the scope or spirit of the invention. For example, features illustrated or described as part of one embodiment, can be used on another embodiment to yield a still further embodiment. It is intended that the present invention cover such modifications and variations as come within the scope of the appended claims and their equivalents.

We claim:

1. A yarn storage mechanism for use on textile spinning machines wherein yarn is delivered from a yarn delivery point at a relatively constant speed, and is wound onto bobbins which may occur at a non-constant rate for conical bobbins, said storage mechanism comprising:

a biased compensator arm disposed to intervene in the course of the running yarn between said yarn delivery point and said bobbin within a first operating range of said compensator arm so that a loop of varying length is formed in the yarn, said compensator arm in continuous contact with the yarn;

a first elastic element connected to said compensator arm so as to exert an increasing force on said compensator arm in opposition to increasing yarn tension from the yarn contacting said compensator arm;

a movable stop disposed so as to contact said compensator arm if said compensator arm travels beyond said first operating range due to increasing yarn tension in opposition to said first elastic element; said compensator arm rotatable about a pivot point and comprising an extension lever on the opposite side of said pivot point for contacting said stop; and a second elastic element connected to said stop, said stop mounted rotatably against the force of said second elastic element, whereby if said compensator arm comes into contact with said stop, said stop is moved by said compensator arm in opposition to said second elastic element thereby preventing said compensator arm from loosing contact with said yarn during peak yarn tension.

2. The yarn storage mechanism as in claim 1, wherein said first and second elastic elements comprise springs.

3. The yarn storage mechanism as in claim 1, wherein said extension lever deflects said stop in opposition to said second elastic element.

4. The yarn storage mechanism as in claim 1, further comprising a device for varying the pre-stress of said first elastic element.

5. The yarn storage mechanism as in claim 1, wherein said compensator arm travels in a horizontal plane.

6. A yarn storage mechanism for use on textile spinning machines wherein yarn is delivered from a yarn delivery point at a relatively constant speed, and is wound onto bobbins which may occur at a non-constant rate for conical bobbins, said storage mechanism comprising:

a biased compensator arm disposed to intervene in the course of the running yarn between said yarn delivery point and said bobbin within a first operating range of said compensator arm so that a loop of varying length is formed in the yarn, said compensator arm in continuous contact with the yarn;

a first elastic element connected to said compensator arm so as to exert an increasing force on said compensator arm in opposition to increasing yarn tension from the yarn contacting said compensator arm;

a movable stop disposed so as to contact said compensator arm if said compensator arm travels beyond said first operating range due to increasing yarn tension in opposition to said first elastic element; said compensator arm rotatable about a pivot point and comprising an extension lever on the opposite side of said pivot point for contacting said stop;

a second elastic element connected to said stop, said stop mounted rotatably against the force of said second elastic element, whereby if said compensator arm comes into contact with said stop, said stop is moved by said compensator arm in opposition to said second elastic element thereby preventing said compensator arm from loosing contact with said yarn during peak yarn tension; and a swivel arm attached to one end of said first elastic element whereby the pre-stress of said first elastic element is changed by changing the degree of swivel of said swivel arm.

7. The yarn storage mechanism as in claim 6, further comprising a control rod operatively connected to said swivel arm whereby movement of said control rod changes the degree of swivel of said swivel arm relative said compensator arm.

8. A textile spinning machine having at least one spinning station wherein yarn is delivered from a yarn delivery point at a relatively constant rate for winding onto a bobbin at a non-constant rate for conical bobbins, said storage mechanism comprising:

a biased compensator arm disposed to intervene in the course of the running yarn between said yarn delivery point and said bobbin within a first operating range of said compensator arm so that a loop of varying length is formed in the yarn, said compensator arm in continuous contact with the yarn;

a first elastic element connected to said compensator arm so as to exert an increasing force on said compensator arm in opposition to increasing yarn tension from the yarn contacting said compensator arm;

a movable stop disposed so as to contact said compensator arm if said compensator arm travels beyond said first operating range due to increasing yarn tension in opposition to said first elastic element;

a second elastic element connected to said stop, said stop mounted rotatably against the force of said second elastic element, whereby if said compensator arm comes into contact with said stop, said stop is moved by said compensator arm in opposition to said second elastic element thereby preventing said compensator arm from loosing contact with said yarn during peak yarn tension; and a swivel arm attached to one end of said first elastic element whereby the pre-stress of said first elastic element is changed by changing the degree of swivel of said swivel arm.

9. The textile machine as in claim 8, wherein said machine comprises a plurality of adjacently disposed spinning stations, said device further comprising a control rod operatively connected to said swivel arm of each said spinning station whereby movement of said control rod simultaneously changes the degree of swivel of all said swivel arms relative their respective said compensator arms.

* * * * *